United States Patent [19]

Müller

[11] 4,085,607

[45] Apr. 25, 1978

[54] HELICALLY CORRUGATING TUBES

[75] Inventor: Kurt Müller, Hanover, Germany

[73] Assignee: Kabel-und Metallwerke Gutehoffnungshutte AG., Hanover, Germany

[21] Appl. No.: 792,726

[22] Filed: May 2, 1977

[30] Foreign Application Priority Data

May 12, 1976 Germany ..... 2620913

[51] Int. Cl.[2] ..... B21D 15/04

[52] U.S. Cl. ..... 72/77

[58] Field of Search ..... 72/77, 78; 29/127, 129

[56] References Cited

U.S. PATENT DOCUMENTS

| | | | |
|---|---|---|---|
| 436,463 | 9/1890 | Richard | 72/78 |
| 928,946 | 7/1909 | Davis | 72/77 |
| 3,998,082 | 12/1976 | Mueller | 72/77 |

*Primary Examiner*—Lowell A. Larson

*Attorney, Agent, or Firm*—Ralf H. Siegemund

[57] ABSTRACT

A corrugation head includes a holder for a two segment, helical corrugating edge with adjustable pitch of the helix as well as of working spiral. The edge extends from two annular segments which have grooves and are held for bending. One of the segments can be pivoted inwardly for adjusting the depth of the corrugation to be made.

6 Claims, 2 Drawing Figures

FIG. 1
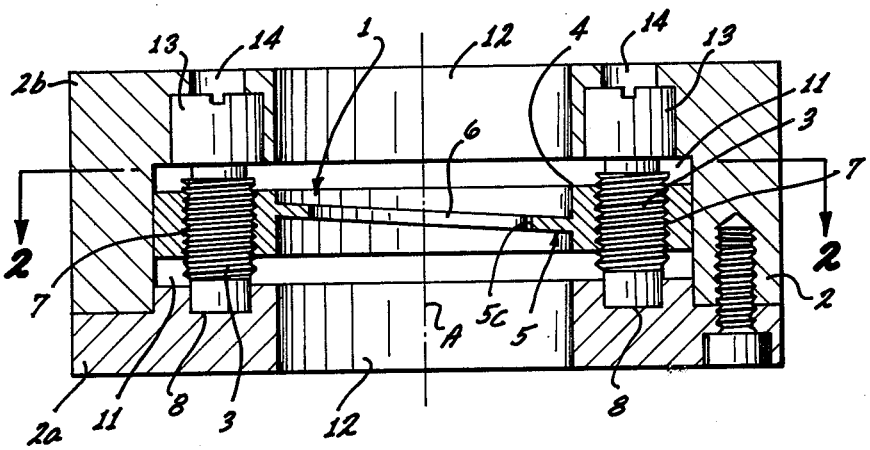
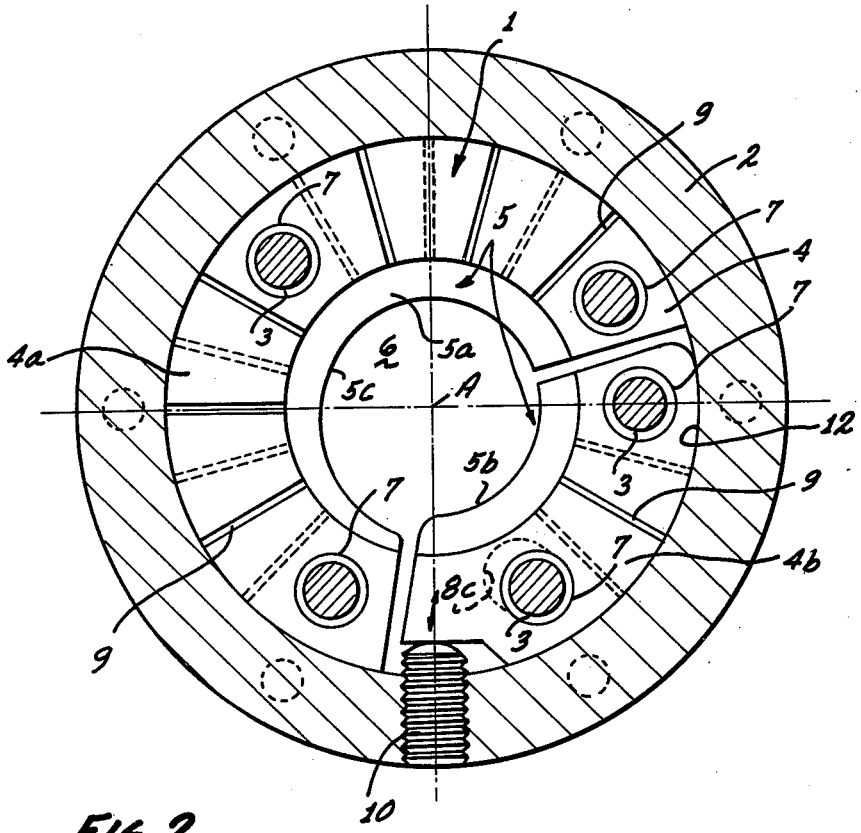
FIG. 2

HELICALLY CORRUGATING TUBES

BACKGROUND OF THE INVENTION

The present invention relates to equipment and machinery for providing smooth wall tubes with helical corrugation. The invention will find particular utility for corrugating tubes which were made originally by longitudinally folding metal strip and longitudinally welding the butting edges; however, the invention is not limited to corrugating that kind of tubing.

Equipment for corrugating smooth walled tubing is comprised, for example, of a corrugating head which can rotate about an axis in a fixed stand. The head includes, particularly, an annular tool moving at the same rotational speed as a corrugating head and having an opening to be traversed by the longitudinally advancing tube to be corrugated. The particular annular tool has, on its inside, a helical working and deforming edge whose smallest diameter is smaller than the outer diameter of the smooth wall tube passing through. The invention, in particular, relates to improvements of equipment of that type.

Other equipment is known for making corrugated tubing whereby in particular two methods or types of methods have become known for obtaining the corrugation. In accordance with a first method, a corrugating tool (roller) rolls on the tube and around the tube to provide thereby a continuous helical corrugation. This method can be considered rather elegant due to the point by point deforming of the smooth wall tube to obtain the corrugation. Moreover, this particular method exhibits very little friction heating and is, therefore, quite suitable for high speed operation. However, it was found that this particular method has a disadvantage in that the point by point formation introduces irregularities in the metal strip as well as in the seam and this may even lead to local detents other than corrugation grooves. It was also found that the distance in axial direction from corrugation ridge to corrugation ridge will not remain constant, for example, due to differences in hardness and strength of the strip material. The invention does not relate to that type of method.

In accordance with a second corrugating method, a particular tool having a single threading is screwed onto the tube to obtain a helical corrugation. This method permits, indeed, the production of a constant corrugation pattern as far as the axial ridge-to-ridge or even peak-to-peak distance of the corrugation is concerned. It was particularly found that for making high frequency cable, this method is quite suitable for exactly that reason (see German printed Pat. application 2,049,235).

In cases, it is desirable to provide corrugating metal tubing in which the corrugation pitch varies. This requirement may exist, for example, in corrugated tubes for high frequency cable and, in particularly, for purposes of employment as a wave guide or in a coaxially type of HF conductor having a corrugated inner conductor and separate corrugated outer conductor.

DESCRIPTION OF THE INVENTION

It is an object of the present invention to provide a new and improved corrugating tool which permits corrugating tubes at variable pitch of the resulting helix.

It is a specific object of the present invention to improve corrugating tooling which includes helical corrugating edge means extending radially inwardly from an annular tool element.

In accordance with the preferred embodiment of the present invention, it is suggested to provide the annular tool element with radial slots and having several azimuthally spaced apart, threaded bores cooperating with bolts which bear against a housing in order to obtain pitch variations of the annulus so that particularly the pitch of the helical working edge is adjusted. It is preferred to construct the annulus from two segments of different azimuthal extension whereby in addition means are provided to pivot at least one of these segments about an axis extending parallely to the axis of a tube to be corrugated so that, for example, one end of that segment can be adjusted as to its distance from that tube and center axis of the corrugating tool. This way one obtains variations in the depth of the corrugating groove.

It can now be seen that aside from carrying out the above stated objects of the invention, it was found that tool adjustment and variations can be carried out rather rapidly which amounts to a saving of extensive tool material.

The particular proportioning of the corrugation pitch, corresponding to the frequency range to be transmitted, permits the elimination or at least significant reduction in reflection.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a cross sectional view through a tool in accordance with the preferred embodiment of the present invention; and FIG. 2 is a side view of that tool.

Proceeding now to the detailed description of the drawings, the figures show a corrugation tool 1 which is held and clamped by means of bolts 3 and 3*a* in an annular housing or casing 2. The assembly 1 and 2 will be secured to a corrugating head of a corrugating station of the type as it is known per se. The head of which housing 2 is a part, rotates about the axis A. Housing 2 is biparted for ease of assembly, and defines an annular groove 11 as well as a cylindrical space 12 for passage of a tube.

The tool 1 is essentially comprised of two annular segments 4*a* and 4*b* which together establish an annulus 4 particularly by virtue of pinning of the segments 4*a* and 4*b* to the bottom part 2*a* of housing 2. The two segments 4*a* and 4*b* respectively have deforming and working edges 5*a* and 5*b* which extend radially inwardly from the segments whereby particularly each of these edges can be regarded as a helical continuation of the respective other one. The working edge means 5 has an inner boundry which defines an opening 6 through which the tube to be corrugated is caused to pass. The radial dimensions of working edge 5 is such that its working surface proper, 5*c*, decreases its distance from axis A, that is to say it spirals inwardly, to obtain gradual formation of a corrugation groove. The particular inner surface 5*c* of the working edge 5 facing the tube to be corrugated is, in addition, provided with hard metal particles which have been soldered onto and along the edges in order to reduce the wear of the working surface 5c.

The two annular segments 4a and 4b each have several bores 7 which are threaded and, therefore, in threaded engagement with bolts 3 and 3a. Unthreaded blind bores 8, 8a in the bottom part 2a of casing 2 receive the, preferably unthreaded, ends of the bolts 3 and 3a. The bolts 3, 3a have heads 12 with screwdriver slots accessible through narrow openings 14 in the top part 2b of housing 2. It can thus be seen, that the bolts are held in the casing and their position remains axially in-variant except for sufficient clearance to permit turning of the bolts.

These bores as well as the bolts 3 and 3a are strategically arranged in that the segment 4a is held at its ends and in the middle. Segment 4b is held near its ends only. Upon turning of the bolts, parts 4a, 4b are moved up and down in groove 11. Individual adjustment, i.e., different turning of the bolts permits deforming of the segments 4a and 4b to thereby vary the pitch of the resulting working edge 5 and that, or course, will change the pitch of the corrugation produced.

In furtherance of the objective of changing the pitch of the corrugation, the annular segments 4a and 4b are provided with grooves 9; these grooves are all arranged in a radial direction which, in turn, improves the bendability of the segments 4a and 4b. The depth of the grooves 9 should, at least, be equal to half the thickness of the members 4a and 4b; this way one can adjust the overall pitch of the segments and of the annulus 4 as a whole quite easily. These grooves do not reduce significantly the mechanical strength of the annulars as a whole. It may well be advisable to provide these radial grooves 9 alternatingly on opposite sides of the respective segment 4a, 4b.

The segment part 4a covers an angle of more than 180°, not quite 270°; the three bore-bolt-blind bore assemblies are about 120° apart. Part 4b extends for less than 180° and has one end portion in engagement with a set or adjusting screw 10 which, in turn, permits that end of the segment 4b to be pivoted in a direction toward or away from the center axis of the tool. In particular, the segment 4b will pivot about the one particular bolt 3 at the other, azimuthal end; it is, therefore, necessary to provide the blind bore 8a for the particular bolt 3a in an oblong configuration permitting radial displacement of that end of segment 4b. The pivoting and pivotal adjustment of segment 4b permits adjusting of the corrugation depth within particular limits.

The invention is not limited to the embodiments described above but all changes and modifications thereof not constituting departures from the spirit and scope of the invention are intended to be included.

I claim:

1. In a machine tool for helically corrugating smooth wall tubes, a corrugating tool for rotation on an axis and co-acting with a tube, the combination comprising: a housing having an opening and a plurality of blind bores arranged around that opening;

an annular means in the housing having inwardly directed helical, working edge means and having a plurality of radial grooves, further having a plurality of azimuthally arranged threaded bores; and a plurality of bolts respectively threadedly inserted in said bores and bearing against said blind bores and being adjusted for defining a particular pitch of the annular means and of the edge means, permitting change of the pitch.

2. The combination as in claim 1 said annular means including a plurality of segments each having a working edge portion of said edge means.

3. The combination as in claim 2 wherein one of said segments extends for less than 180° azimuthally and having one end pivotally connected to said housing by means of one of said bolts, one of said blind bores, receiving another of said bolts, having an oblong configuration for permitting said one segment to be pivoted about an axis of said one bolt.

4. The combination as in claim 1 where said annular means including two segments, one extending by more than 180° azimuthally, the other one extending by less than 180° azimuthally.

5. The combination as in claim 1 said radial grooves having a depth at least equal to half the width of the annular means.

6. The combination as in claim 1 said groove: alternating on opposite, axial end faces of the annular means.

* * * * *